United States Patent [19]

Cotton, Jr.

[11] 4,312,189

[45] Jan. 26, 1982

[54] AIR CONDITION SYSTEM CONTROLLED RESPONSIVE TO THE ABSOLUTE HUMIDITY OF AIR IN A DESIGNATED TREATED SPACE

[75] Inventor: Worth B. Cotton, Jr., Greensboro, N.C.

[73] Assignee: Industrial Air, Inc., Greensboro, N.C.

[21] Appl. No.: 157,690

[22] Filed: Jun. 9, 1980

Related U.S. Application Data

[63] Continuation-in-part of Ser. No. 914,028, Jun. 9, 1978, abandoned.

[51] Int. Cl.[3] ..... F25D 17/04; F24F 3/14; B01F 3/02

[52] U.S. Cl. ..... 62/176 C; 62/179; 165/21; 236/44 A

[58] Field of Search ..... 62/176 E, 176 C, 179; 236/44 B, 44 A; 165/21, 20

[56] References Cited

U.S. PATENT DOCUMENTS 3,277,954 10/1966 Meckler ..... 165/20

3,965,690 6/1976 Berryhill ..... 62/121

*Primary Examiner*—William E. Wayner

*Attorney, Agent, or Firm*—Charles R. Rhodes; Judith G. Smith

[57] ABSTRACT

Return air from a work area is so treated as to arrive at a prescribed temperature/humidity level responsive to a direct acting absolute humidity sensing and control apparatus. The return air is mixed with fresh air, then subjected to a water spray in an air washer. The air mixture is controlled by the absolute humidity control device to maintain a constant absolute humidity level. The amount of water sprayed is controlled by a dry bulb thermostat which in turn operates to throttle the spray as necessary to reach the prescribed temperature level in an evaporative cooling technique.

6 Claims, 2 Drawing Figures

AIR CONDITION SYSTEM CONTROLLED RESPONSIVE TO THE ABSOLUTE HUMIDITY OF AIR IN A DESIGNATED TREATED SPACE

REFERENCE TO RELATED APPLICATIONS

This application is a continuation-in-part of my copending application Ser. No. 914,028, filed June 9, 1978, now abandoned.

BACKGROUND OF THE INVENTION

In most industrial air conditioning systems it is required that the air in the treated space be maintained at prescribed temperature and humidity levels. Toward this end air is taken from a treated area, which air has increased in temperature (temperature rise) due to the heat of the machines in the area, the number of people in the area, the type of processing being carried out in the area, and even the outside weather conditions. This return air is passed through a conditioning system where it is cleaned, cooled, and the humidity thereof controlled to such an extent that the room conditions including the humidity level may be maintained. It is imperative in many, particularly industrial, situations that the absolute humidity level be maintained constant so as not to adversely effect the processing carried on therein.

In conventional air conditioning equipment such goals have been accomplished by completely cooling the return air in an air washer to substantially the dew point corresponding to the absolute humidity level of the treated space. Such an approach is quite satisfactory assuming the temperature difference between the dew point and room conditions equals the actual temperature rise which occurs. However, for various reasons such full load temperature rise does not occur. For example, on a cloudy or cool day, or where some machines are idle or for other similar reasons, the full load conditions do not exist and in fact the temperature rise may only be 50% to 70% of the temperature difference between dew point and room conditions. If full load treatment continues, the temperature will drop below the desired level.

In known systems such partial load conditions are compensated for in one of two ways or a combination of the two. First of all the supply air may be heated by an auxiliary heating device immediately upon its leaving the air washer and prior to the time it is introduced into the heated space to such an extent that, when coupled with the room conditions, the full load temperature rise will occur. Secondly, some of the return air may be routed around or by-pass the air washer so that not all of the return air is treated. Also, combinations of these two systems are commonly utilized. Both solutions to the problem, however, have undesirable characteristics. For example, intentional heating of the supply air requires wasted energy input, as well as requiring the chilling of the return air past the desired temperature point all the way back to the dew point; it being understood that the only way to control a system in which a dry bulb thermostat can satisfactorily control the system is to first of all achieve saturation. In the second approach (by-pass) additional space and equipment is required to route a portion of the air around the washer which results in more expensive and space consuming installations.

The real problem of the above systems which has been realized and overcome in the instant invention is the conventional use of the dry bulb temperature sensing device to control the moisture content. A dry bulb temperature sensing device has no way of measuring and maintaining a desired humidity level in the air. Therefore in such systems the only way to be sure of maintaining a desired moisture content, as well as a prescribed temperature is to cool all the way to the dew point (saturation), then reheat or by-pass as discussed above.

SUMMARY OF THE PRESENT INVENTION

The present invention then is directed to an improved air conditioning system which overcomes the problems outlined hereinabove. In the present invention the return air is not by-passed around the air washer; neither is it fully saturated then heated back to a point sufficient to maintain the room conditions under a partial load situation. Rather a desired condition is maintained by treating the return air only enough to return it along a constant humidity line to the desired point of the supply air. On a psychrometric chart the treatment line is equal in length to the actually occurring partial load conditions.

Toward this end the heart of the system lies in the use of a dew point control device which utilizes an absolute humidity sensing probe in the supply air stream leaving the air washer prior to the time it is introduced into the treated space. Therefore, not only is the temperature known, but also the absolute humidity level. The dew point control device then operates return air/fresh air dampers as is necessary to modulate the humidity level of the air as needed to maintain desired room absolute humidity conditions. A dry bulb thermostat in the treated space modulates a throttle valve between the air washer pump and the spray nozzles thereof to vary the amount of water sprayed into the return air/fresh air mixture only sufficiently to compensate for the temperature rise actually occurring, even under a partial load situation. Further, where the aforementioned conditioning of return air and fresh air does not reach the desired condition (as when the outside air is not drier (less absolute humidity) or is not cooler (less enthalpy)) the absolute humidity sensing device through the dew point control device controls a supply of chilled water leading to the air washer pump to change the temperature of the water to a desired level.

Therefore it can be seen that the return air is not always returned to the saturated condition then heated back to a prescribed point in order to maintain room conditions. Nor is some of the return air by-passed around the air washer which leads to the problems set forth hereinabove. Rather, humidity is primarily controlled by constantly mixing more or less fresh air with the return air and this mixture is modulated responsive to the absolute humidity sensing device. Therefore, the idea of controlling the air mixture with an absolute humidity sensing device rather than a dry bulb thermostat leads to the improvements set forth hereinabove.

It is therefore an object of the present invention to provide an improved air conditioning system which eliminates the necessity for introducing heat into the conditioned air stream or by-passing the air washer under partial load conditions.

It is another object of the present invention to provide an improved air conditioning system of the type described in which a prescribed temperature and moisture content is maintained responsive to an absolute humidity sensing device in the supply air stream.

Other objects and a fuller understanding of the invention will become apparent from reading the following detailed description of a preferred embodiment along with the accompanying drawings in which:

FIG. 1 is a schematic view illustrating the control loop system according to the present invention; and FIG. 2 is a simplified psychrometric chart to which reference will be made in the explanation of the invention.

DETAILED DESCRIPTION OF A PREFERRED EMBODIMENT

Figure 1:
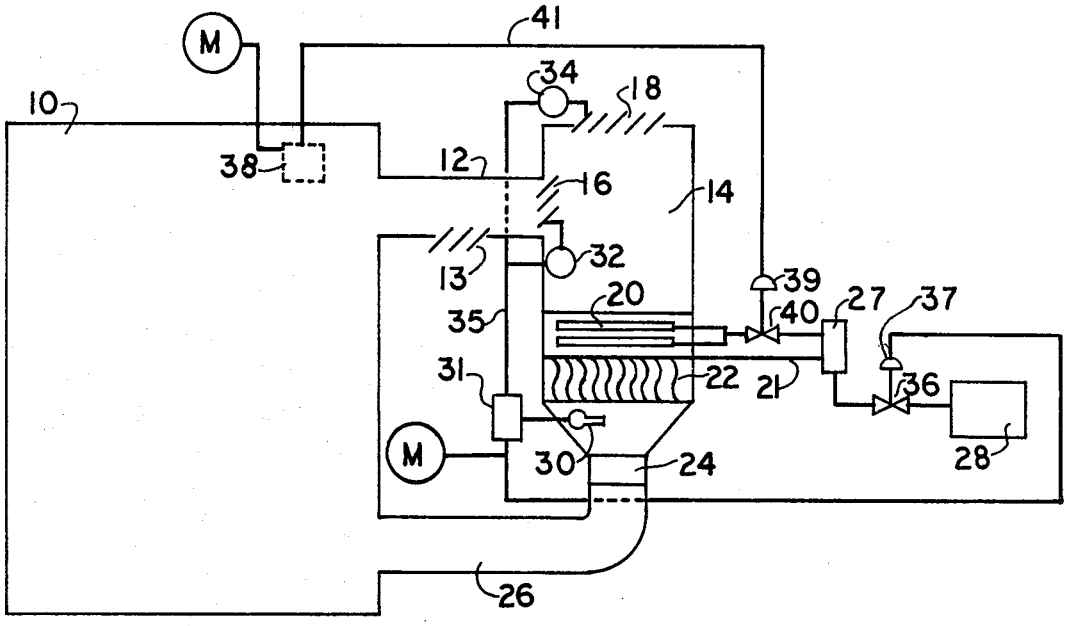

The following detailed description of the working embodiment of the invention will explain the arrangement of devices, which in themselves are known, however, are not believed to have been assembled previously in the unique combination of the present invention. In general, the invention is envisioned for use in the type of air conditioning system in which exhaust or return air from a work area 10 or other area in which air is conditioned, is passed through a conduit 12 into a mixing chamber 14 through an adjustable damper 16. This air may be subjected to some type of separation equipment (not shown) if desired. Additionally, fresh air may be introduced to the mixing chamber 14 through an adjustable damper 18. Where mixing occurs, the unused return air is bled off through any conventional relief damper 13. The means for adjusting dampers 16 and 18 will be discussed hereinafter. After the air is mixed it is passed through a spray washer, the temperature is reduced to a desired level. After the air leaves the eliminator section 22 it is returned to the treated area 10 through conduit 26. A fan 24 is illustrated in FIG. 1 as being placed downstream of the washer 20 which is known as a draw through system. Alternatively it is possible to place the fan 24 upstream of the washer 20 which is known as a blow through system. Further, filters or separating devices may be provided in either conduit 12 or between mixing chamber 14 and spray section 20, however, the filtering and separating section forms no part of the present invention.

Water is introduced to the spray section or nozzles 20 by means of a pump 27 which pushes or urges water through a throttling valve 40 into the nozzles 20, whereupon the water is collected in the bottom of the washer section and returned to the pump for recycling through conduit 21. In order to control the temperature of the water which goes through sprays 20 and must be periodically cooled, a source of chilled water 28 is provided, which is periodically introduced to the pump and its closed loop system by means of a chilled water valve 36.

Downstream of the air washer 20 is placed an absolute humidity sensing device 30 in the path of the air after it leaves the washer section. This device called a dew cell 30 is connected into and activates a dew point control device 31. A dew point controller is a conventionally available instrument which responds to a humidity sensing device to regulate the flow of air from a source M through a conduit 35 leading to, for example, air operated motors. One example of an absolute humidity sensing device is the Foxboro Model 2701 G dew call. This dew cell 30 is an electrically heated, self-regulating lithium chloride dew point hygrometer. The device includes a sleeve coated with lithium chloride which absorbs water from the air and becomes conductive depending upon the amount of water absorbed. The preferred dew point controller 31 is the Taylor Model 127 RT 1001. This device is direct acting, i.e. if the absolute humidity increases, the line pressure increases resulting in more fresh air, less return air. With these devices the absolute moisture level can be determined and maintained.

A first air operated damper motor 32 is connected to the normally open return air damper 16 for operation thereof. Motor 32 is connected on the output side to the dew point controller 31 and set to be activated (begins to close) at 5 psi. When 10 psi is in the line 35 damper 16 will be fully closed. A second motor 34 is similarly connected between the controller 31 and the normally closed fresh air damper 18. When the 5 psi is reached in line 35 damper 18 begins to open and is fully open when the 10 psi level is reached. Also, the dew point controller 31 is connected to the third motor 37 which operates chilled water valve 36. Motor 37 is set to be activated at 10 psi to maintain the temperature of the water being circulated by pump 27 when outside conditions (higher absolute humidity or higher enthalpy) make it necessary to further cool the water to maintain the desired moisture level. In some climates, the chilled water source 28, its valve 36 and third motor 37 might not be needed.

A dry bulb thermostat 38 is provided in the treated area 10 and controls the air pressure to a throttling means in the form of valve 40 for adjusting the amount of water being transmitted to the sprays 20. This reduction of water flow (throttling) is what keeps the condition of the return air from becoming fully saturated as it evaporatively cools. Therefore the mixture of air and amount of spray are both controlled to recondition the return air only to such an extent as is necessary to return to desired conditions.

Figure 2:
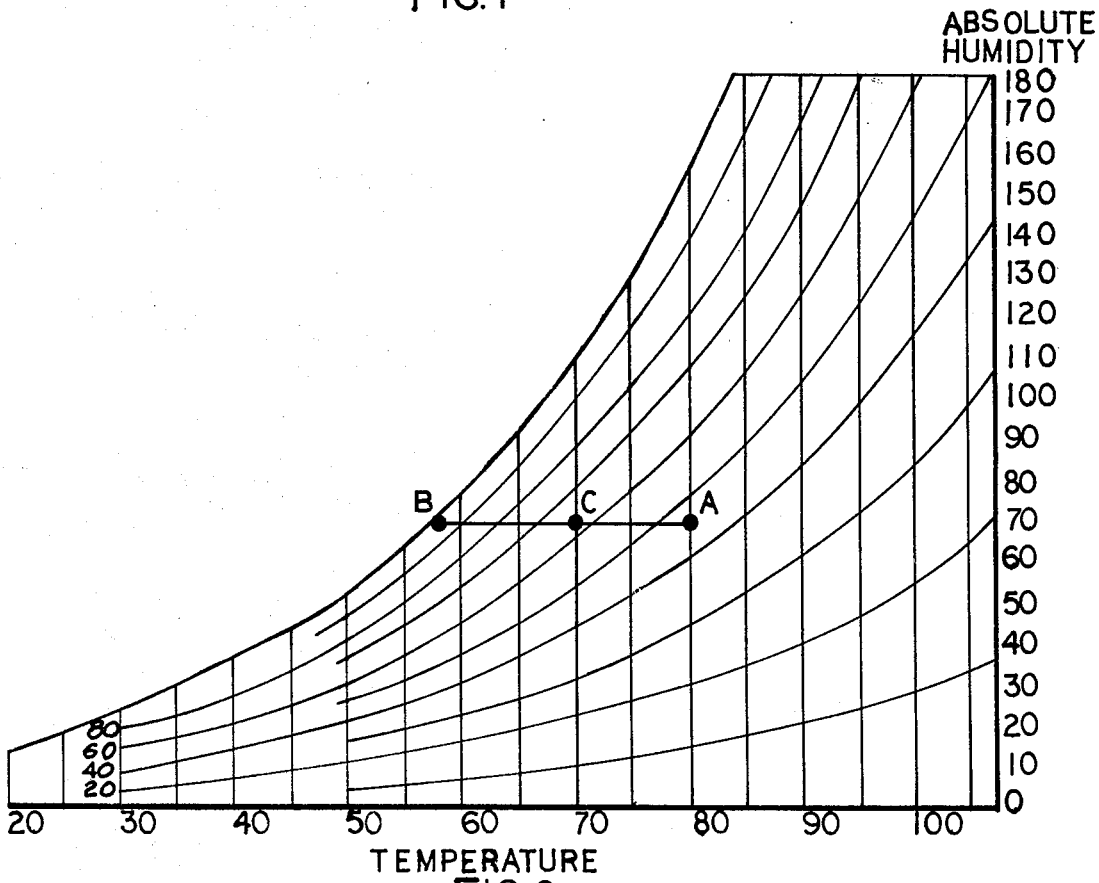

In operation the advantages of this system may be best explained by referring to FIG. 2 which is a simplified psychrometric chart illustrating a straight line defined by the letters A, C, B. First of all by way of explanation, point A on the line represents the desired room conditions which are desired to be maintained (assume 80° F., 45% relative humidity). Point B represents in a conventional dry bulb thermostat controlled system, the condition of the air as it leaves the air washer always, regardless of whether there is full or partial load conditions (58° F., 95% relative humidity). As long as full load conditions exist, this type of operation is entirely satisfactory. However, as explained hereinabove, usually the room conditions will only increase the heat a portion of the line distance AB as represented by the line AC. In conventional equipment, therefore, auxiliary means (heaters, by-pass) must be used to move the air leaving the air washer to point C (70° F. 62% relative humidity), rather than point B. Otherwise, the load conditions in the room will not be sufficient to maintain the room at point A. Therefore, either the air leaving the air washer is heated by an auxiliary heater from point B to point C or else part of the return air by-passes the air washer so that the mixture of the washed air and unwashed air downstream of the air washer is at point C.

By means of the above-described application, the return air never gets back to point B in partial load conditions (that is, the return air that goes through the air washer is not fully saturated or returned to the dew point). The dew point controller maintains a constant absolute humidity level. The throttle valve 40 actually reduces the efficiency of the air washer, so that the condition of the air is returned only to the point C in FIG. 2. As can be seen this results in the elimination of either the by-pass equipment or the heat energy input which is of course wasted and which is required to move the air from point B to point C in FIG. 2.

Although a preferred embodiment of the preferred invention has been described in detail hereinabove it is apparent that various changes and modifications might be made without departing from the scope of the present invention which is set forth in the following claims.

What is claimed is:

1. In an air conditioning system for a precribed area said system being of the type including a fresh air/-return air mixing chamber; separate dampers for the fresh air and return air inputs into the mixing chamber; and air washer with associated pump and spray valve; eliminator section; and means for moving air through said system back into said prescribed area as supply air; the improvement comprising:

(a) an absolute humidity monitoring device in the path of said supply air;

(b) control means for modulating said fresh air and return air dampers responsive to said absolute humidity monitoring device to achieve a fresh air/-return air mix that results in the maintenance of a constant absolute humidity level;

(c) a dry bulb temperature sensing device in said prescribed area; and (d) a throttling means associated with said spray valve and connected to said temperature sensing device for increasing and decreasing the water flow through the spray nozzles of said air washer responsive to temperature fluctuations in said prescribed area.

2. The improvement according to claim 1 wherein said absolute humidity control device includes a sensor and an air pressure regulating device, and said control means comprises an air operated damper motor connected to said fresh air damper and a second air operated damper motor connected to said return air damper, said return air damper being normally open and said fresh air damper being normally closed, said regulating device being responsive to a change in absolute humidity level of said supply air to partially close said return air damper and partially open said fresh air damper to achieve a prescribed humidity level in the resulting mixed air.

3. The improvement according to claim 1 wherein said air washer is provided with a chilled water supply and further including an adjustable valve between said chilled water supply and said pump, said valve being adjusted responsive to said absolute humidity sensing device to raise or lower the temperature of the water running through said air washer.

4. A method of efficiently treating return air to maintain presecribed conditions of absolute humidity and temperature within a work area regardless of the temperature rise on the air in the work area comprising the steps of:

(a) maintaining a constant absolute humidity level of said return air responsive to continuous monitoring of the absolute humidity level of the supply air being returned to said work area;

(b) subjecting said return air to an air washer being operated at least a part of the time under less than full spray conditions;

(c) throttling the amount of water supplied to said air washer responsive to a dry bulb thermostat in said work area to cool said air only by an amount equal to the temperature rise in said work area.

5. The method according to claim 4 wherein the absolute humidity is maintained by mixing said return air with outside air when said outside air is cooler and drier than said return air.

6. The method according to claim 5 wherein the absolute humidity is maintained by lowering the temperature of the water supplied to said air washer at times when the absolute humidity is not maintained only by mixing outside air with the return air.

* * * * *